US012163274B2

(12) United States Patent
Lundt et al.

(10) Patent No.: US 12,163,274 B2
(45) Date of Patent: Dec. 10, 2024

(54) LINEN SPREADER APPARATUS

(71) Applicant: Jensen Denmark A/S, Rønne (DK)

(72) Inventors: Morten Lundt, Rønne (DK); Kim Cordua, Rønne (DK)

(73) Assignee: Jensen Denmark A/S, Ronne (DK)

( * ) Notice: Subject to any disclaimer, the term of this patent is extended or adjusted under 35 U.S.C. 154(b) by 0 days.

(21) Appl. No.: 17/927,095

(22) PCT Filed: Apr. 28, 2021

(86) PCT No.: PCT/EP2021/061106
§ 371 (c)(1),
(2) Date: Nov. 22, 2022

(87) PCT Pub. No.: WO2021/239368
PCT Pub. Date: Dec. 2, 2021

(65) Prior Publication Data

US 2023/0243086 A1 Aug. 3, 2023

(30) Foreign Application Priority Data

May 25, 2020 (DK) ..... PA202070333

(51) Int. Cl.
*D06F 67/04* (2006.01)

(52) U.S. Cl.
CPC ..... *D06F 67/04* (2013.01)

(58) Field of Classification Search
CPC ..... D06F 67/00; D06F 67/04
See application file for complete search history.

(56) References Cited

U.S. PATENT DOCUMENTS 3,604,132 A * 9/1971 Thompson ..... D06F 67/04 38/143
3,664,046 A * 5/1972 Thompson ..... D06F 67/04 198/570

(Continued)

FOREIGN PATENT DOCUMENTS

DE 3119574 A1 12/1982
EP 2977505 A1 1/2016

(Continued)

OTHER PUBLICATIONS

International Preliminary Report on Patentability in the corresponding International Application No. PCT/EP2021/061106 dated Nov. 17, 2022 (8 pages).

(Continued)

*Primary Examiner* — Ismael Izaguirre
(74) *Attorney, Agent, or Firm* — McDermott Will & Emery LLP

(57) ABSTRACT

The present invention relates to linen spreader apparatus including a conveyor defining a machine direction, a pair of spreader clamps movable transversally to said machine direction towards each other, and away from each other for spreading out a piece of linen, at least one charger station, each charger station delivering a corner of a leading portion of a piece of linen to a respective one of said spreader clamps, a transfer beam for transferring a piece of spread out linen from said at least one pair of spreader clamps to said conveyor, said transfer beam having a leading edge and a trailing edge and being arranged to move back and forth in said machine direction between advanced and retracted positions, said leading edge of said transfer beam located in a region below said spreader clamps in said advanced position, said transfer beam being configured for temporarily holding on to a portion of said piece of linen as the transfer beam moves from said advanced position towards (Continued)

said retracted position, and an elongated transverse abutment structure having an abutment face, for holding a portion of said piece of linen between said leading edge of said transfer beam and said abutment face, pressurised air exits for directing said leading portion of said piece of linen onto said transfer beam when said piece of linen is released from said spreader clamps, wherein said transfer beam is having a main body, wherein said leading edge is movable to and from said main body.

13 Claims, 17 Drawing Sheets

(56) References Cited

U.S. PATENT DOCUMENTS

| | | | | | |
|---|---|---|---|---|---|
| 3,729,846 | A * | 5/1973 | Weir | D06F 67/04 38/143 |
| 4,299,521 | A | 11/1981 | Jensen | |
| 4,437,247 | A * | 3/1984 | Wiebesiek | D06F 67/04 38/143 |
| 5,172,502 | A * | 12/1992 | Kober | D06F 67/04 38/143 |
| 8,845,259 | B2 * | 9/2014 | Nielsen | D06F 67/04 38/143 |
| 2017/0335505 | A1 * | 11/2017 | Maejima | D06F 67/04 |
| 2019/0301081 | A1 | 10/2019 | Nakamura | |

FOREIGN PATENT DOCUMENTS

| | | | |
|---|---|---|---|
| JP | H08324858 | A | 12/1996 |
| JP | H0754262 | A | 2/2005 |
| JP | 2007-092255 | A | 4/2007 |
| JP | 2007159921 | A | 6/2007 |
| WO | 2005/038121 | A2 | 4/2005 |
| WO | 2006/125656 | A1 | 11/2006 |
| WO | 2007/134601 | A1 | 11/2007 |
| WO | 2018/105363 | A1 | 6/2018 |

OTHER PUBLICATIONS

Search Report issued in the corresponding Danish Patent and Trademark Office for corresponding application No. PA 2020 70333 dated Nov. 5, 2022.

Japanese Office Action issued in corresponding Japanese Application No. 2022-571125 dated Aug. 20, 2024 with English translation.

* cited by examiner

LINEN SPREADER APPARATUS

CROSS REFERENCE TO RELATED APPLICATIONS

This application is the U.S. National Phase under 35 U.S.C. § 371 of International Application No. PCT/EP2021/061106, filed on Apr. 28, 2021, which claims the benefit to Danish Application No. PA202070333, filed on May 25, 2020, the entire contents of each are hereby incorporated by reference.

BACKGROUND

In linen spreader apparatuses the transfer of a spread out piece of linen hanging suspended from two spreader clamps to the moving surface of a conveyor is frequently carried out using a moving transfer beam that extends transversally with respect to the direction in which the conveyor surface moves. The direction in which the conveyor surface moves represents what can be referred to as a machine direction of the apparatus.

The transfer beam is arranged to move in the aforementioned machine direction between an advanced position and a fully retracted position. In the advanced position a leading edge of the transfer beam is located in a region below the two spreader clamps. When the transfer beam is in this position the spreader clamps are controlled to release their grip on the corners of the suspended piece of linen, whereby a leading portion of the piece of linen falls down to lie flatly onto the top surface of the transfer beam, by the simultaneous application of a sideways oriented blast of air.

The transfer beam is configured for temporarily holding on to the leading portion of the piece of linen as the transfer beam is then moved in the machine direction from the advanced position to fully retracted position in which the leading edge of the transfer beam is above the moving conveyor surface. This movement leads to a further part of the piece of linen being brought into contact with the moving surface of the conveyor. The temporary holding of the leading portion is released well before the transfer beam reaches its fully retracted position whereby the leading portion of the piece of linen slides off the transfer beam and falls down onto the moving conveyor surface. For this sliding off to take place the transfer beam is accelerated, or otherwise moved away from the leading portion of the piece of linen. The remaining portion of the piece of linen is then drawn onto the conveyor by the moving conveyor surface.

The piece of linen is then moved onwards by the conveyor for further processing, lying flat in a spread out fashion on the conveyor surface, and the transfer beam moves back towards its advanced position.

While the present invention may find particular use in the context of industrial laundries wherein the piece of linen is a piece of washed laundry fed to an ironing roller by the aforementioned conveyor, the invention may also find other uses, such as where the piece of linen is fed directly to a folder for folding the piece of linen. The term linen as used herein applies without limitation to towels, bedsheets and other fabrics.

Examples of apparatuses operating in the aforementioned manner are disclosed in U.S. Pat. No. 4,299,521, WO 2009/076958, JPH 08324858 A, WO 2007/134,601 and JP 4,358,820, of which the last two also disclose examples of charger stations that each include a pair of feeder clamps, each feeder clamp delivering one corner of the piece of linen to a respective one of two spreader clamps. The present invention may find use with any type of charger station configured to deliver two corners of a piece of linen to a respective one of two spreader clamps, such the ones disclosed in WO 2005/049,911 or WO 2016/162,334.

In some of the known apparatuses the transfer beam temporarily holds on to the leading portion of the piece of laundry by suction, as disclosed in JP 8-324,858 and WO 2009/076,958. Alternatively, the transfer beam may include for this purpose a series of clamping devices arranged along the length of a trailing edge of the transfer beam, as shown in JP 4,358,820.

In JP 4,358,820, the transfer beam is so arranged that in its advanced position a portion of the piece of linen is held between the leading edge of the transfer beam and an abutment face defined by an abutment structure. At this time the spreader clamps release their grip on the corners of the piece of linen and pressurised air is applied to direct the released leading portion of the piece of linen forwards onto the top surface of the transfer beam. The clamping devices of the transfer beam are then activated to temporarily hold on to the leading portion of the piece of linen and the transfer beam is moved away from the abutment face in the machine direction, with the clamping device then releasing the leading portion whereby the piece of linen eventually is fully carried, and advanced onwards, by the conveyor.

As may be understood, for this linen transfer it is generally required that the piece of linen comes to lie flatly on the conveyor surface without any folds. Sometimes, however, the spreader clamps may have received and grip onto a very large part of the linen fabric at the corner of the piece of linen whereby the leading portion of the piece of linen that comes to lie on the transfer beam will appear with folds. These folds often remain when the piece of linen is transferred to the conveyor and then to the ironer/folder, whereby this particular linen item must be returned to the apparatus for a renewed run-through, reducing the overall efficiency of the apparatus.

The object of the present invention is inter alia to provide an improved apparatus of the aforementioned type where undesired folds in a leading linen portion may be avoided.

SUMMARY

According to one aspect of the invention, which may find use independently of or together with a second aspect of the invention also described herein, a linen spreader apparatus is improved by providing a novel construction of an abutment structure for the spreader boom, allowing for the holding of the piece of linen with a uniform pressure along substantially its entire width.

According to a second aspect of the invention, which may find use independently of or together with the first aspect of the invention, a linen spreader apparatus is improved by providing a novel construction of the spreader boom, whereby the width of the spreader boom seen in the machine direction may be adjusted.

Using pressurised air exits as per claim 1 may be regarded as optional.

Preferred embodiments are defined in the dependent claims.

DETAILED DESCRIPTION

The invention will now be explained in more detail below by reference to presently preferred embodiments.

Figure 1:
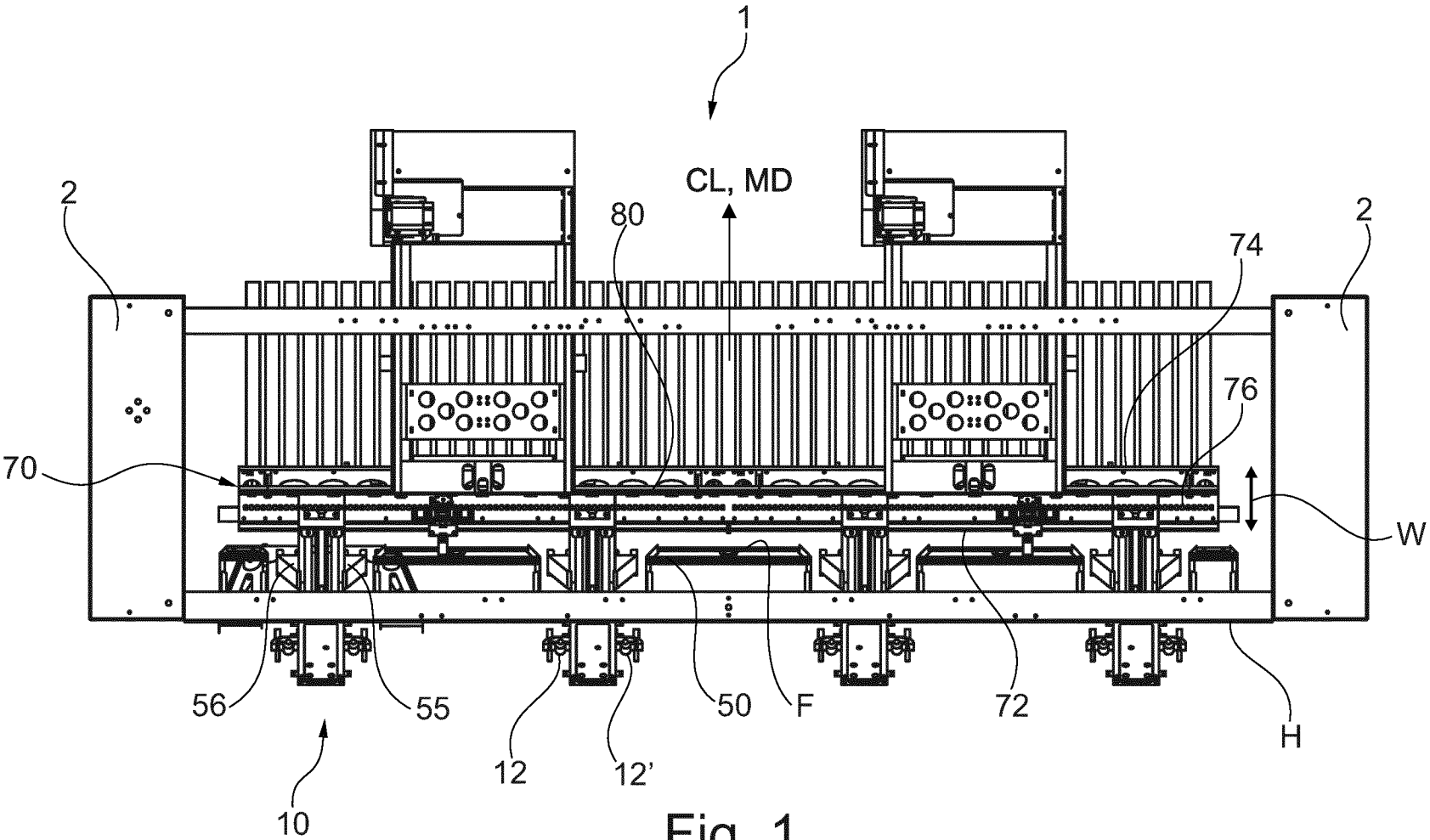
FIG. 1 is a top view of a linen spreader apparatus of the invention.

FIG. 1 is a top view of a linen spreader apparatus 1 of the invention, including four charger stations 10, each for carrying respective pieces of linen to the inside of a housing H of the apparatus 1.

Figure 2A:
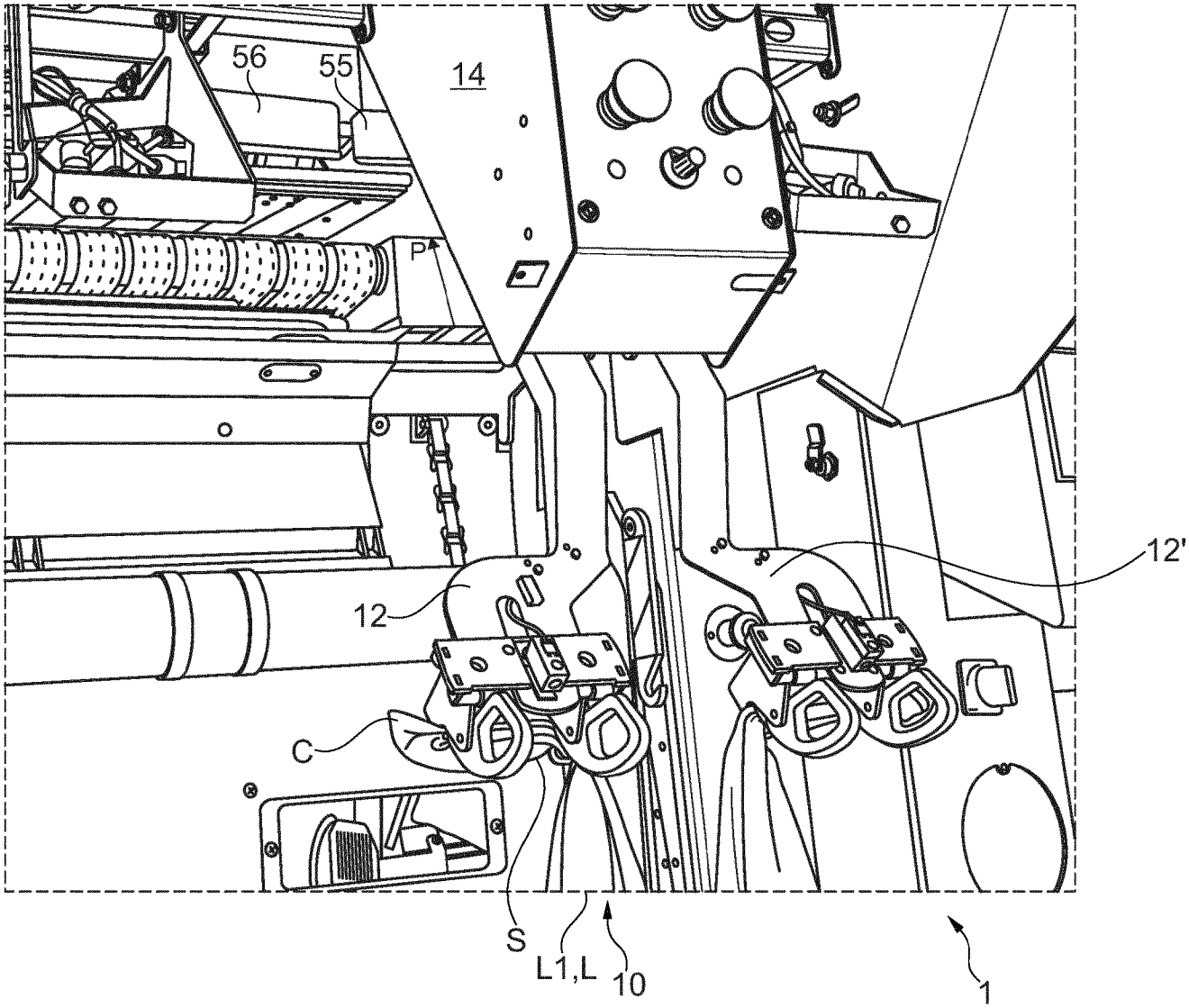
FIGS. 2*a* and 2*b* are perspective front views of a charger station of the linen spreader apparatus, with a piece of linen being advanced along a pathway into the inside of the apparatus of FIG. 1.

FIG. 2*a* shows a perspective front view of the charger station 10 illustrated to the left in FIG. 1. Such charger stations 10 generally comprise a pair of feeder clamps 12, 12' that each grasp onto a respective corner portion C of the same piece of linen L, and a raising/lowering device 14 that raises the pair of feeder clamps 12, 12' for moving the hanging piece of linen L up along a pathway P into the inside of the housing H. The piece of linen may, by way of example only, be a towel or a bedsheet, and the length of the apparatus 1 between the two opposite sides 2 of the housing H defines the maximum width of linen that may be spread out by the apparatus 1.

Figure 2B:
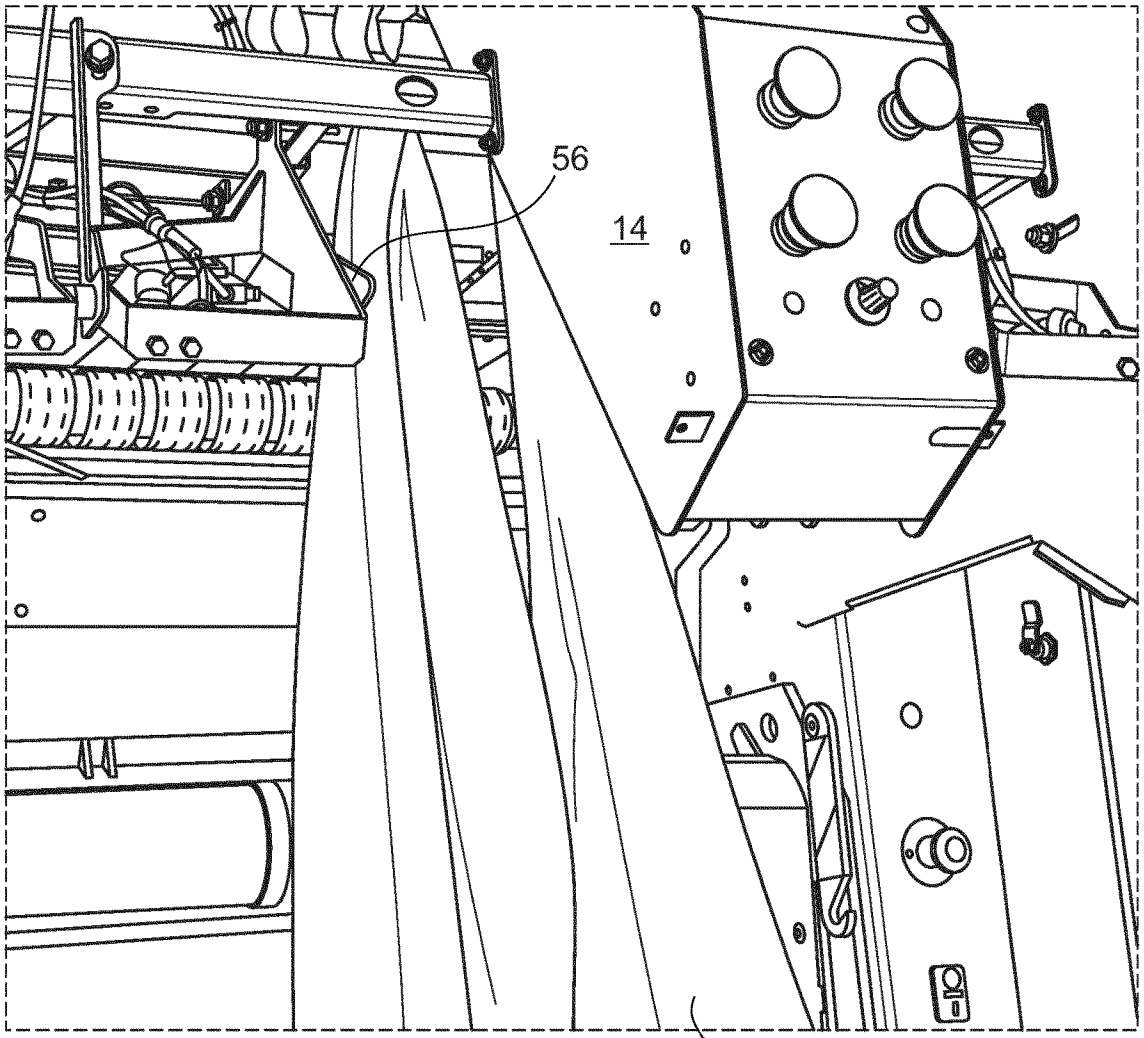

FIG. 2*b* shows the feeder clamps 12, 12' in their raised position at which a pair of spreader clamps (not shown) movable along a supporting elongated rail take over the piece of linen L from the pair of feeder clamps 12, 12', each spreader clamp grasping then onto a part S (see FIG. 2*a*) of a respective one of the aforementioned corner portions C. Multiple pairs, such as two pairs, of spreader clamps may be mounted to move along the supporting rail, as shown in eg. WO 2016/162,334, to each take over a piece of linen L one at a time in the apparatus and for onwards delivery of the piece of linen L to the spreader boom in the manner described herein.

Figure 3:
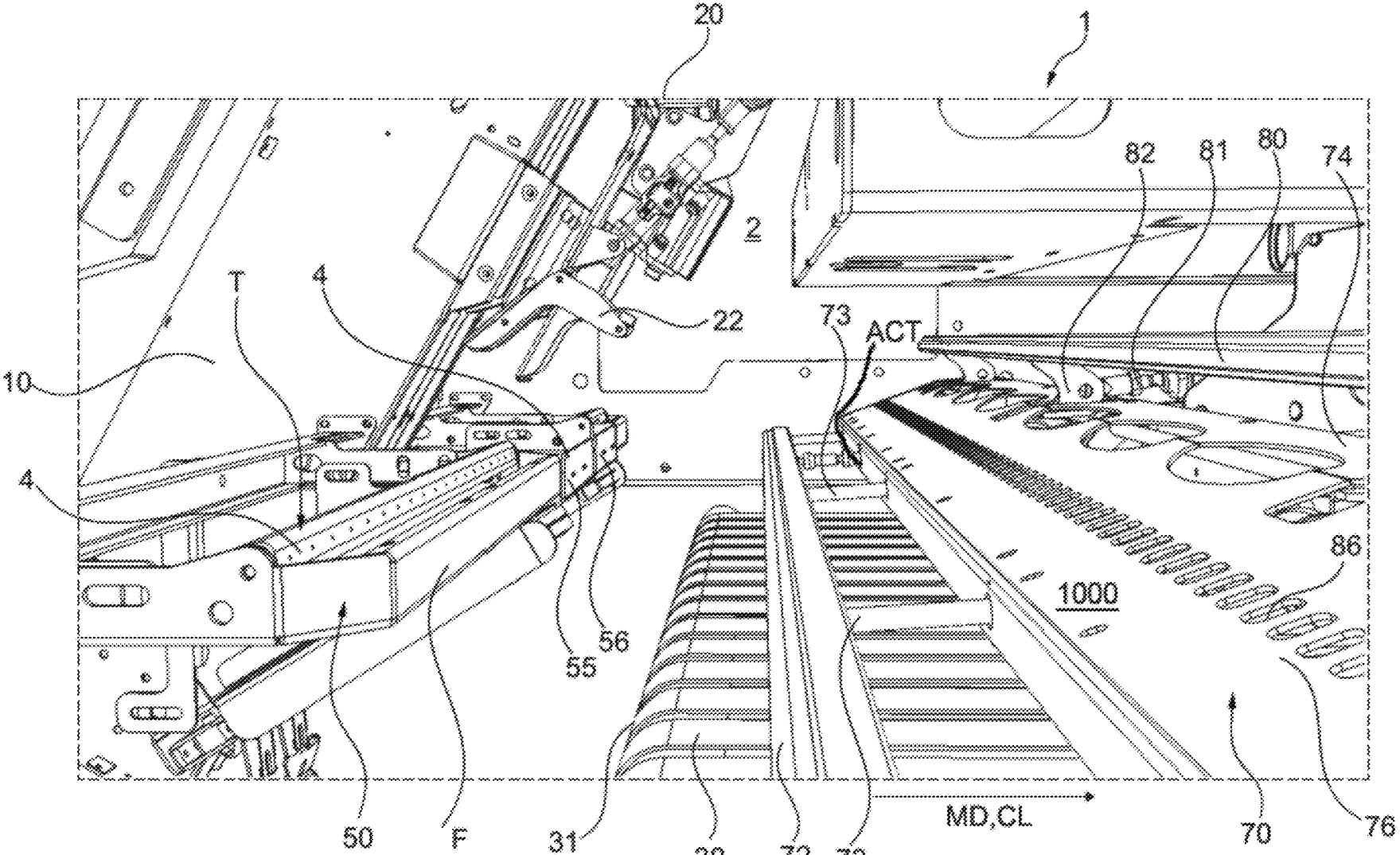
FIG. 3 is a sectional perspective view of the linen spreader apparatus of FIG. 1, FIGS. 4 and 5 are top views showing a linen spreader apparatus with gates arranged in the linen pathway illustrated in a closed and open position, respectively.

As is conventional, the pair of spreader clamps are then caused to move apart from each other to spread out the piece of linen L received from the pair of spreader clamps, and the spread out piece of linen L hanging suspended from the spreader clamps is then transferred onwards using a retractable elongated transfer beam 70, shown in FIG. 3. The transfer beam 70 has an upper surface against which a trailing portion of the linen L is placed to lie flatly thereon, held there for a short time while the transfer beam 70 is moved to the right in FIG. 3 towards a fully retracted position above a belt conveyor 30. The belt conveyor 30 is arranged and configured to advance the spread out piece of linen L in a machine direction MD for further processing. It will be understood that the transfer beam 70 and the supporting elongated rail 20 for the spreader clamps 22 both extend transverse to the machine direction MD, between the two opposite sides of the apparatus 1, of which one side is shown by numeral 2 in FIG. 3, normally to serve all the charger stations 10 of the apparatus 1. Often, the conveyor 30 is a belt conveyor comprising parallel ribbon loops defining the moving surface.

The transfer beam 70 is arranged to move back and forth in the machine direction MD between an advanced position and the aforementioned fully retracted position; FIG. 3 shows one embodiment of the transfer beam 70 as it moves to the left, towards its advanced position, as well as one of the two spreader clamps 22 positioned at the charger station 10, the other spreader clamp (not shown) moving towards the charger station 10 along the rail 20.

In an advanced position of the transfer beam 70 is a leading edge 72 thereof located in a general region below the two spreader clamps 22, positioned against an abutment face F of an elongated abutment structure 50 that extends between the two opposite sides 2 of the apparatus 1.

When the transfer beam 70 is in this fully advanced position the two spreader clamps 22 are controllable to release their grip on a suspended piece of linen L, whereby a leading portion of the piece of linen L, under the action of a high pressure flow of air exiting a row of air nozzles 4 of a tubular structure T extending between the two opposite sides 2, falls flatly onto the upper surface of a main body 76 of the transfer beam 70 while a trailing portion of the piece of linen L for a short while remains suspended, engaged between the leading edge 72 of the transfer beam 70 and the abutment face F of the abutment structure 50, as will be explained further below. To increase frictional hold on the piece of linen L the abutment face F and the opposite face of the leading edge 72 may be provided with a suitable surface covering, such as a rubbery material.

The transfer beam 70 is configured for temporarily holding, such as by vacuum applied via a row of apertures 86 and/or by (as illustrated) a clamping device in the form of an elongated clamping structure 80, on to the leading portion of the piece of linen L as the transfer beam 70 is then moved from its advanced position and to the right in FIG. 3 towards its fully retracted position in which the leading edge 72 of the transfer beam 70 is at a maximum distance away from and to the right of the front end 31 of the conveyor 30. This movement leads to a further portion of the piece of linen L being drawn onto the moving surface of the conveyor 30.

The temporary holding of the leading portion of the piece of linen L by the transfer beam 70 is released, such as by actuators acting on the elongated clamping structure 80 or by release of vacuum, before the transfer beam 70 reaches its fully retracted position, at which time the speed of movement of the transfer beam 70 towards its fully retracted position is increased relative to the moving conveyor 30 whereby the leading portion of the piece of linen L slides off the transfer beam 70 and falls onto the moving surface of the conveyor 30. The remaining portion of the piece of linen L is then drawn up onto the conveyor 30 by the moving conveyor surface.

In some special cases the width of a piece of linen L fed into the apparatus 1 may be such that for a required final positioning of the piece of linen L on the conveyor 30, symmetrically about the longitudinal centre line CL of the conveyor 30 (see FIG. 1), spreading out of the piece of linen L will require the spreader clamps 22 to be at a position at a charger station 10 when the piece of linen L is spread out. According to one aspect of the invention, the path P (see FIG. 2*a*) of movement of the linen L by the feeder clamps 12, 12' at some or all charger stations 10 may be automatically closed once the hanging piece of linen L has reached the inside of the housing H, below the rail 20 that supports the spreader clamps 22, 22'. This is achieved by providing according to one aspect of the invention, the abutment structure 50 with a number of gates, preferably arranged in pairs, at some or all of the charger stations 10. FIG. 2*a* shows one such pair of gates 55, 56 in a closed position while in FIG. 2*b* the gates 55, 56 have each been turned to an open position allowing the suspended piece of linen L to enter the inside area of the apparatus 1. Once the piece of linen L is inside the apparatus 1 the gates 55, 56 are closed again whereby they assume the position also shown in FIG. 3. This allows for the gates 55, 56 to define a portion of the aforementioned abutment face F also in the area of the charger station 10, against which abutment face F a trailing portion of the piece of linen L may be held by the leading edge 72 of the transfer beam 70.

For the aforementioned special case, providing gates 55, 56 as discussed ensures that as the spreader clamps 22 release the piece of linen L a trailing portion thereof is temporarily held along its entire width between the transfer beam 70 and the abutment face F. In other words, the pull from gravity on the leading portion of the piece of linen L is the same along its full width transverse to the machine direction MD. This to a high degree ensures that the leading edge of the piece of linen L lies along a straight line when the leading portion of the piece of linen L is subsequently brought to lie on the surface of the transfer beam 70 by a blast of air exiting the nozzles 4.

Figure 4:
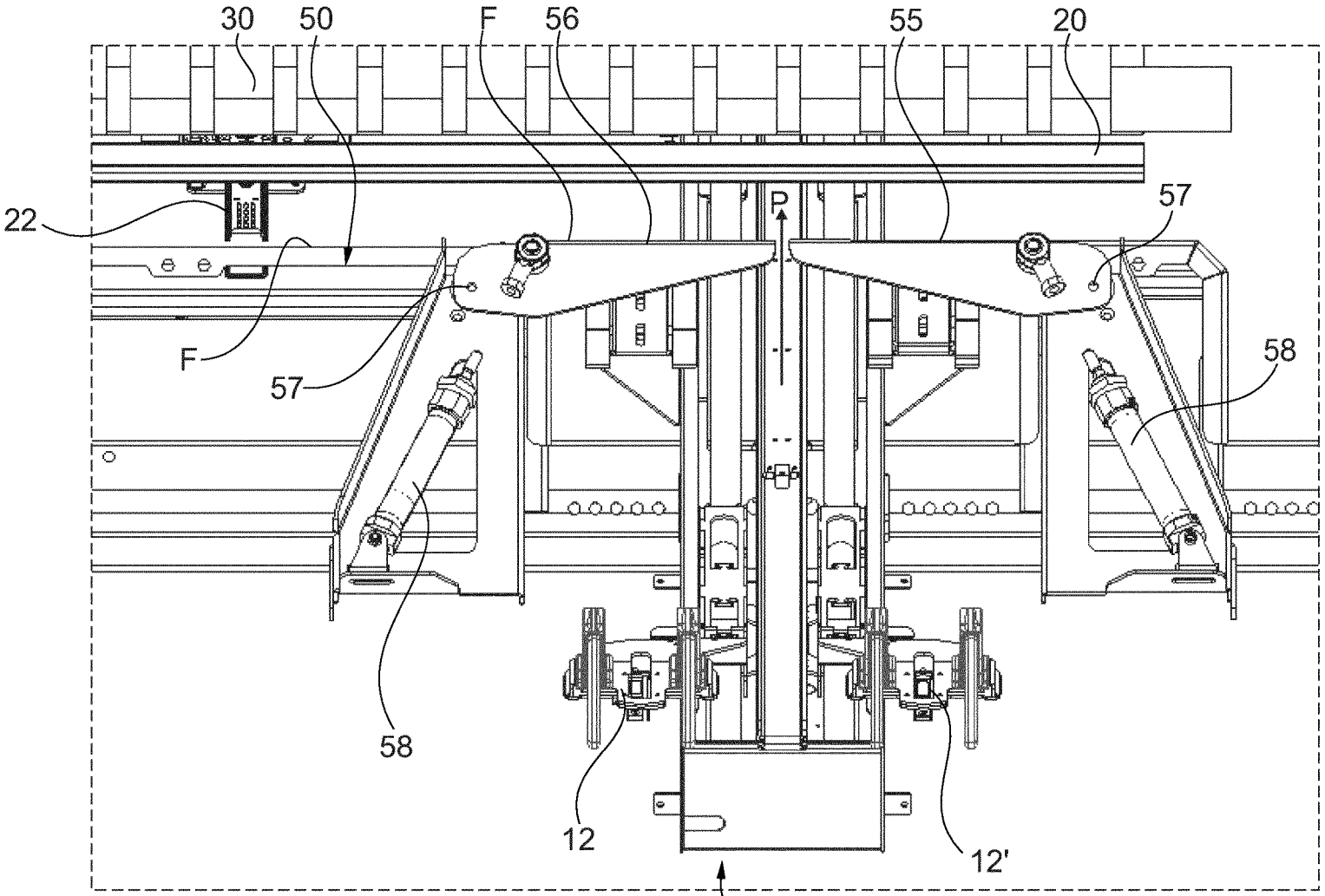
Figure 5:
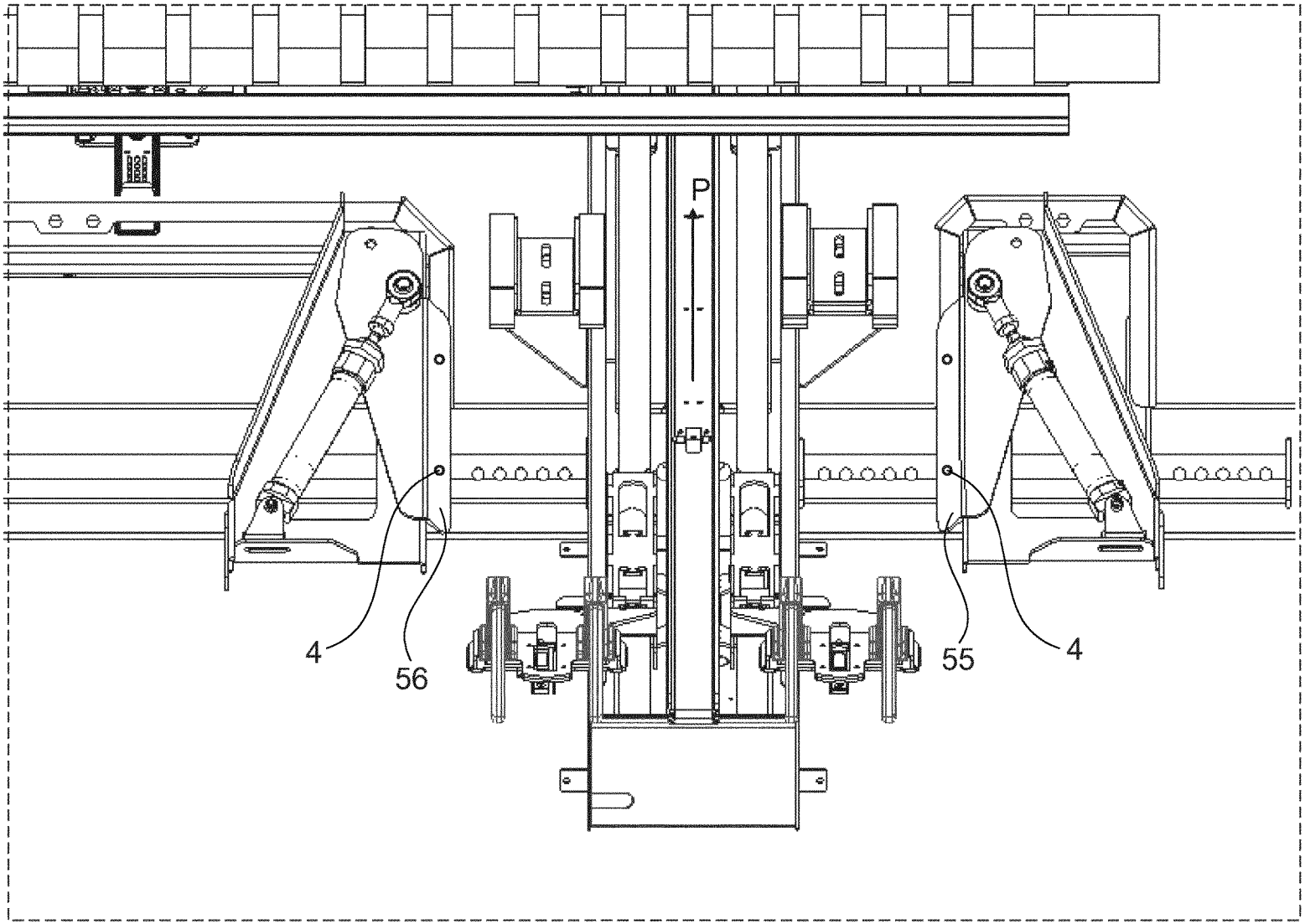

The closed (first) and open (second) positions of the two gates 55, 56 are shown in FIGS. 4 and 5 respectively, also showing the pathway P of the suspended linen L into the inside of the apparatus 1. The gates 55, 56 are each turned about an axis 57 by a respective actuator 58 but other arrangements may readily be contemplated. Preferably, as shown only in FIGS. 3 and 5 herein, the gates 55, 56 also include nozzles 4 for discharging air in the closed position of the gates 55, 56. In this manner the leading portion of the suspended spread out piece of linen L may be subjected to the aforementioned blast of air along its entire extension transverse to the machine direction MD. For this the gates 55, 56 may be hollow and supplied with pressurised air that exits through a row of nozzles 4, or an elongated slit (not shown) defining a single nozzle 4, formed in each of the gates 55, 56. Alternatively, a separate tubular structure (not shown) with such air nozzles 4 may be mounted to the gates 55, 56. The nozzles 4 of the gates 55, 56 may in one embodiment (not shown) be aligned with the row of the remaining nozzles 4 of the abutment structure 50.

Turning now to a second aspect of the invention, which may find use independently of the aforementioned first aspect of the invention, reference will now first be made again to FIG. 3 which shows how the transfer beam 70 according to the second aspect of the invention may be constructed to have a variable effective width W (see FIG. 1) measured between its leading edge 72 and its trailing edge 74, i.e. a controllable width W parallel with the machine direction MD. Specifically, the transfer beam 70 may have a main body 76 having the trailing edge 74 and from which the leading edge 72 may be moved by connector bars 73 configured to move into and out of the main body 76 by any suitable actuator(s) ACT arranged inside the main body 76. The leading edge 72, which is an elongated unitary structure connected to the aforementioned connector bars 73, may be biased towards a normal position adjacent to the main body 76 whereby activation of the suitable actuators of the transfer beam 70 move the leading edge 72 parallel with the machine direction MD into a desired position some distance away from the main body 76, as shown in FIG. 3, for the reason explained below and of particular, but not exclusive, relevance where the transfer beam 70 is configured for temporarily holding on to the leading portion of the piece of linen L by an elongated clamping structure 80 arranged at the trailing edge 74 of the transfer beam 70 as the transfer beam 70 is moved from the advanced position towards the fully retracted position.

Figure 13:
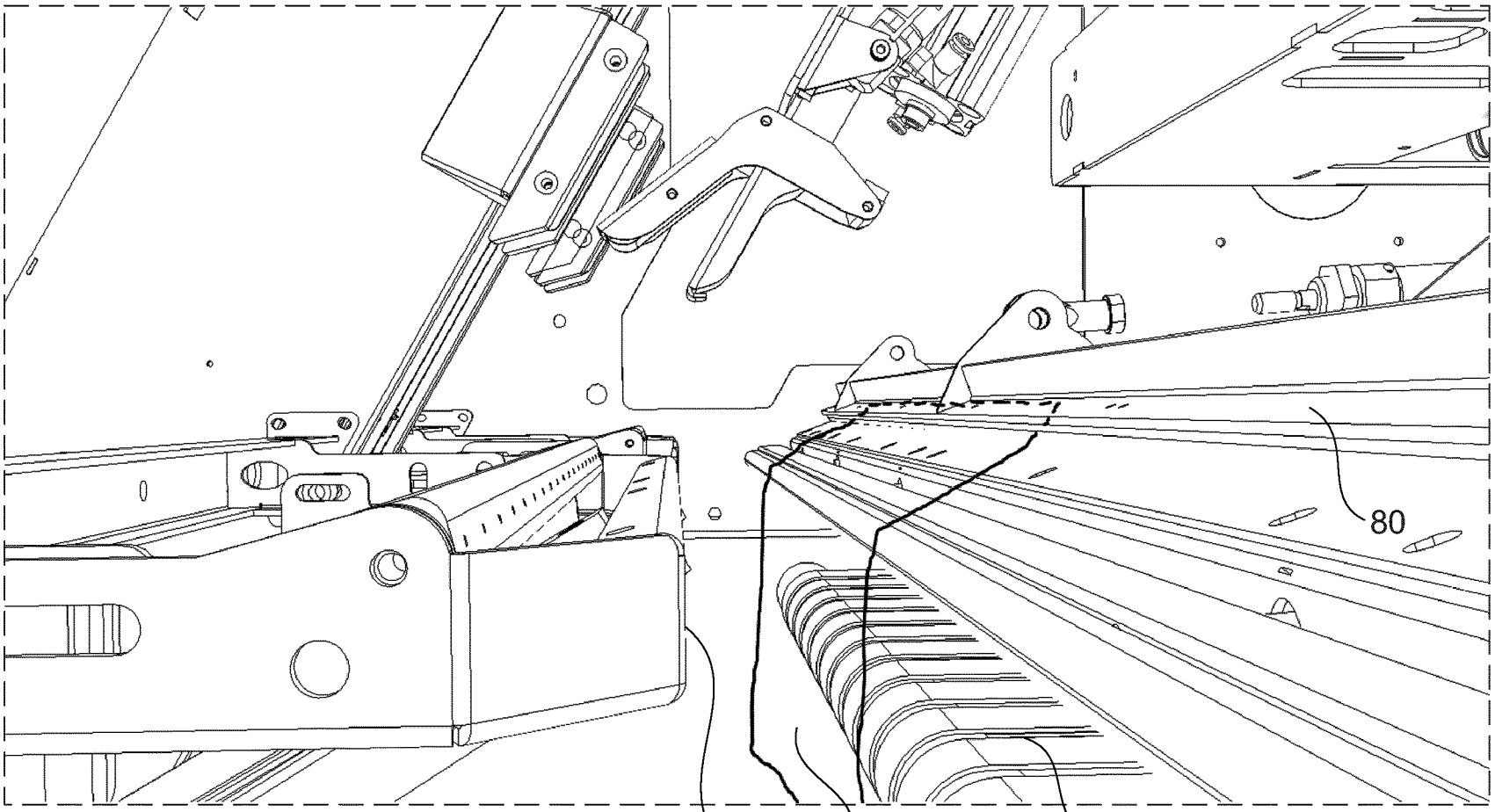

Normally, the main body 76 with its leading and trailing edges 72, 74 extends along the full width of the apparatus 1 between the two opposite sides 2. In FIG. 1 the transfer beam 70 is shown with the leading edge 72 adjacent to the main body 76, the aforementioned effective width W being then at its minimum, see also eg. FIG. 13.

Figure 6:
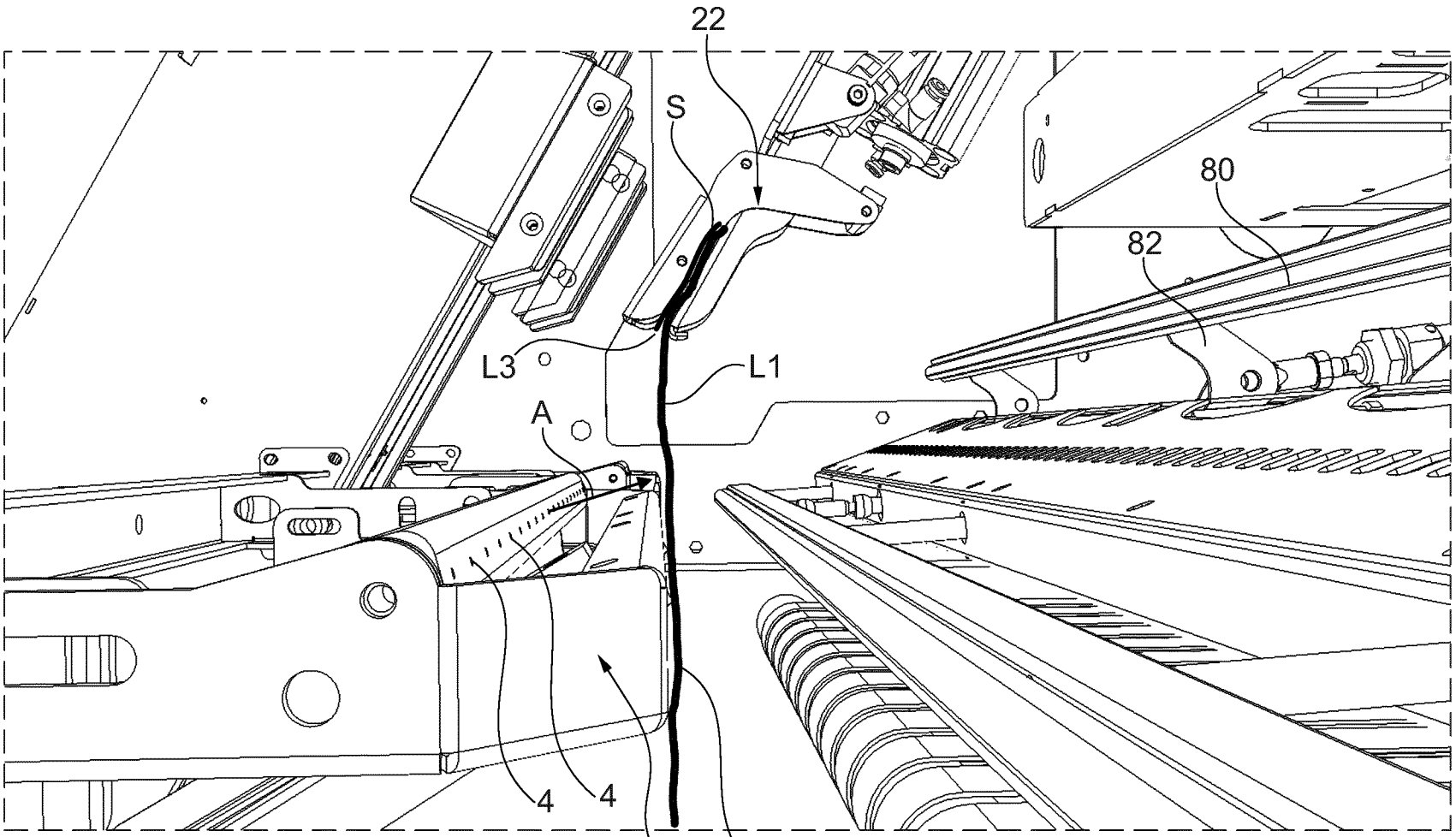
FIGS. 6-9 are views similar to FIG. 3, showing steps in the transfer of a piece of linen to the transfer beam, with a large part of the linen fabric held by the spreader grips.

FIG. 6 shows the corner portion C of a piece of linen L that has been received by one of the spreader clamps 22 as discussed above. As illustrated schematically in FIG. 6 the spreader clamp 22 holds in this case on to a substantial, back-folded (along fold line S) portion of the piece of linen L, which may be the result of an operator having introduced too much fabric into the feeder clamps 12, 12', as schematically shown in FIG. 2*a*. In such a special case, as the spreader clamps 22 release the piece of linen L and the relatively large leading portion L1 thereof driven by air blast A falls onto the transfer beam 70 the latter may not accommodate the full extent of the leading portion L1; this will lead to folds being formed as the leading edge L3 of the piece of linen L strikes the brackets 82 holding the clamping structure 80, which folds will typically also be there after the piece of linen L is deposited on the conveyor 30. Alternatively, part of the relatively large leading portion L1 including its leading edge L3 may fall over the trailing edge 74 of the transfer beam 70 and interfere with the subsequent depositing of the piece of linen L onto the conveyor 30. This may, by way of example, be the case where the transfer beam 70 is configured for the temporarily holding by vacuum applied via a row of apertures 86, in lieu of a clamping structure 80.

By incorporating sensors, a detection, accompanied by a subsequent analysis, of the textile load held by the spreader clamps 22 may be carried out whereby the aforementioned transfer beam 70 actuators ACT may be activated as shown in FIG. 6 to move the leading edge 72 of the transfer beam 70 away from the main body 76 as the transfer beam 70 is moved from its retracted position towards the abutment structure 50. Movement is controlled so that the main body 76 stops moving when the leading edge 72 reaches the abutment face F.

Figure 7:
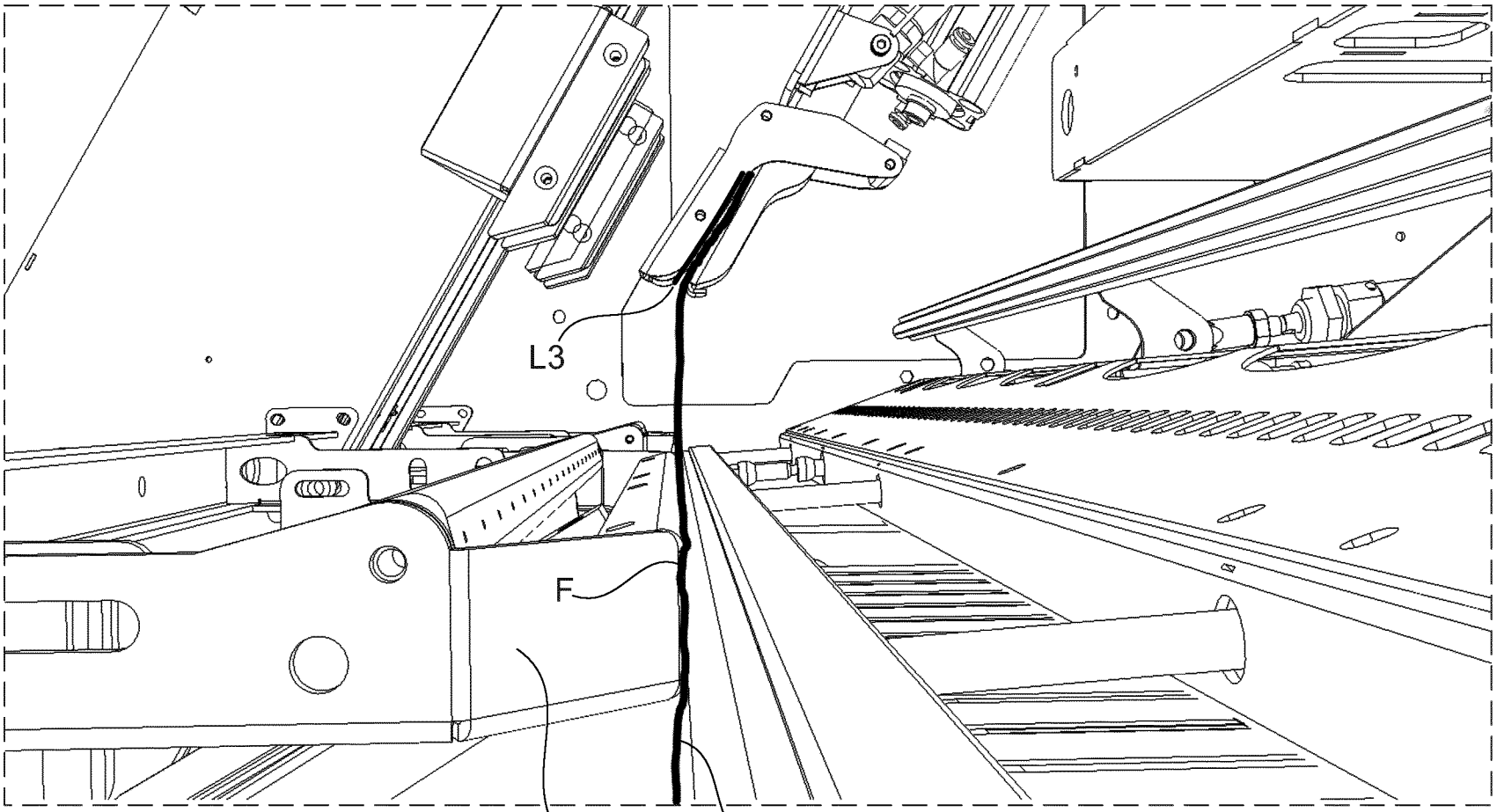
Figure 8:
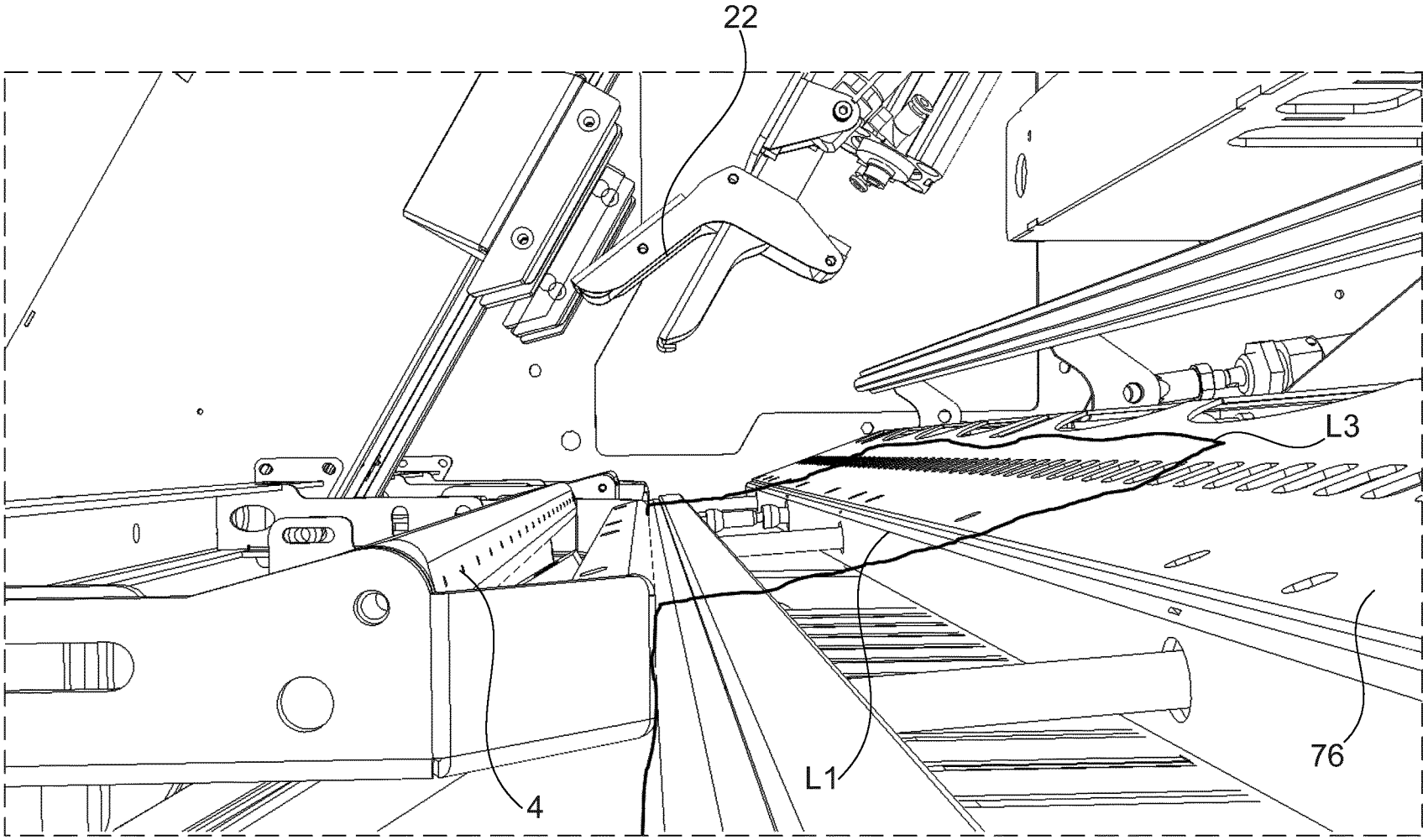

FIG. 7 shows the transfer beam 70 leading edge 72 now holding a part of the trailing portion L2 of the piece of linen L against the abutment structure 50. FIG. 8 shows the leading portion L1 then lying flatly against the main body 76 of the transfer beam 70, having been released from the spreader clamps 22 and positioned by the air flow A exiting nozzles 4 while the transfer beam 70 leading edge 72 still holds onto the trailing portion L2.

Figure 9:
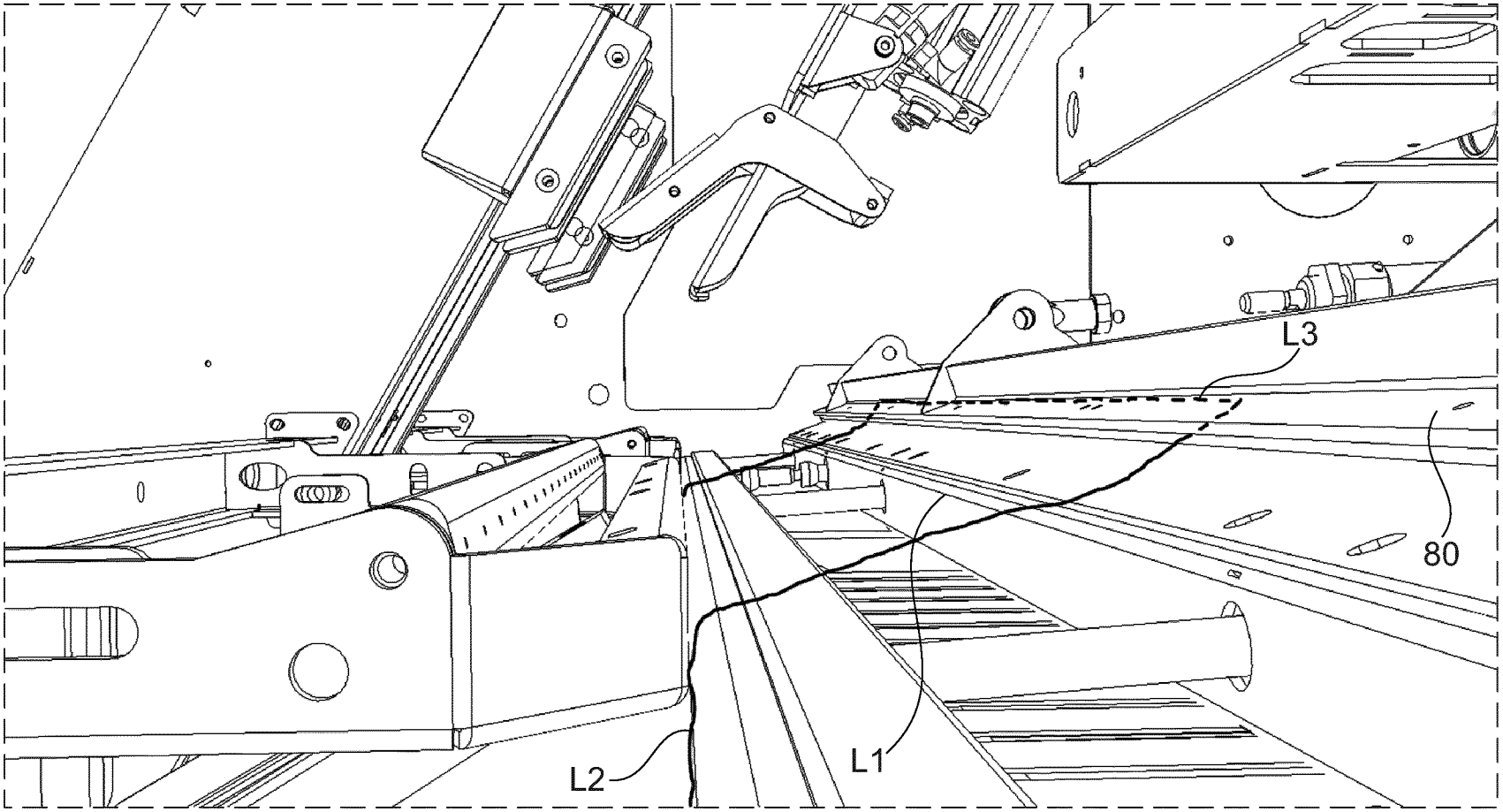

Next, as shown in FIG. 9, the clamping structure 80 is activated to hold the leading edge L3 of the piece of linen L against the upper surface 1000 of the main body 76.

By way of example only, the aforementioned sensors may be included in the spreader clamps 22 and may detect the extent to which the two jaws of each spreader clamp 22 move together.

Shown in FIGS. 10-13 is the operation of the apparatus 1 in the normal case where there has been no detection of excess fabric held by the spreader clamps 22, i.e. where the transfer beam 70 leading edge 72 is not extended/moved from the main body 76. It is noted that movement of the leading edge 72 relative to the main body 76 may also follow the leading edge 72 being normally biased towards an extended position shown in FIG. 3 by springs incorporated in the actuator(s) ACT whereby the main body 76 in such a normal case is advanced sufficiently towards the abutment face F that the leading edge 72 is pressed fully towards the main body 76 and preferably locked in that position by a lock included in the transfer beam 70 until the piece of linen L has been deposited on the conveyor 30. The lock may be provided by the actuator(s) ACT that move the leading edge 72 into the desired position.

Figure 10:
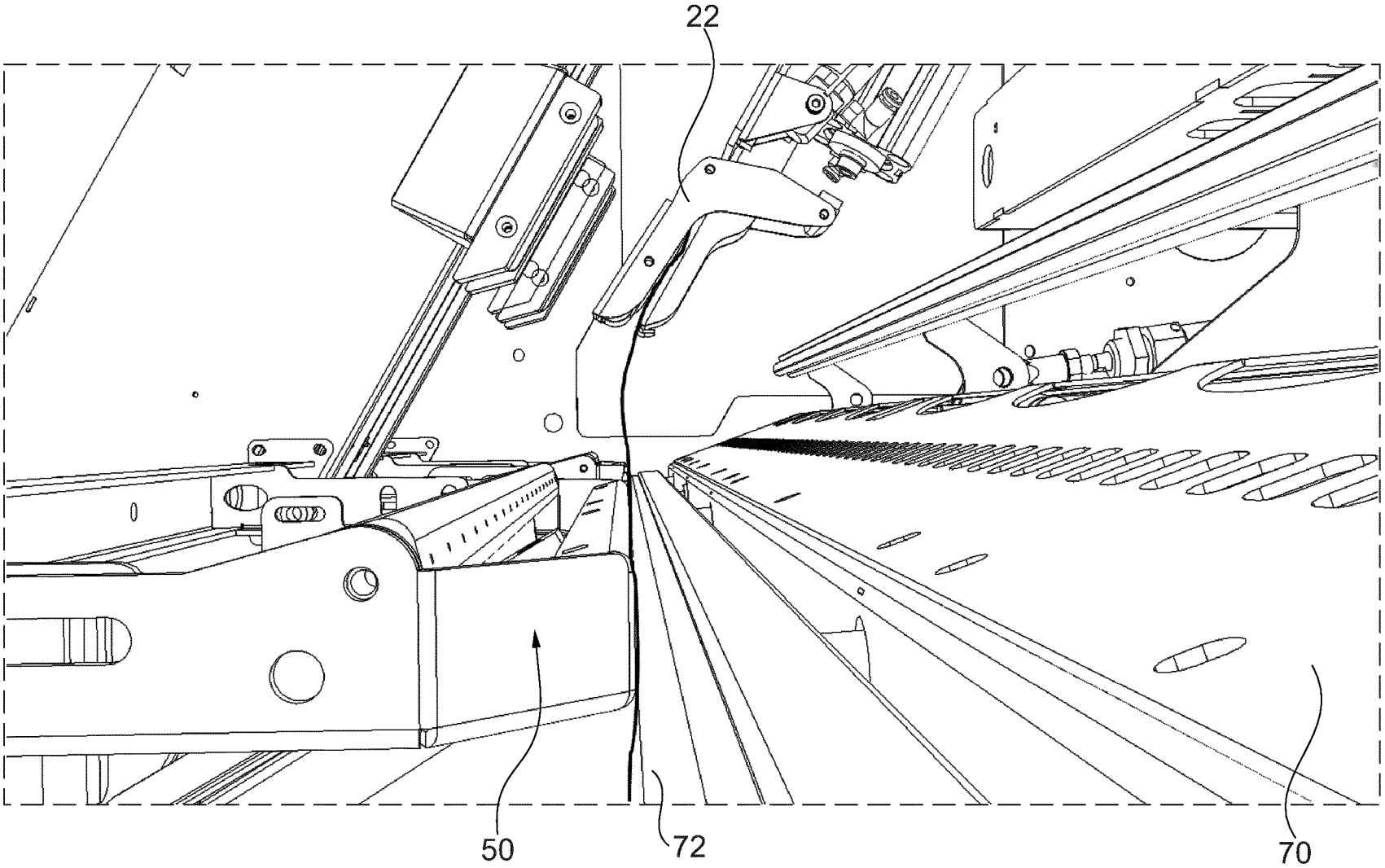
FIGS. 10-13 are views similar to FIG. 3, showing steps in the transfer of a piece of linen to the transfer beam, with a normal part of the linen fabric held by the spreader grips.
Figure 11:
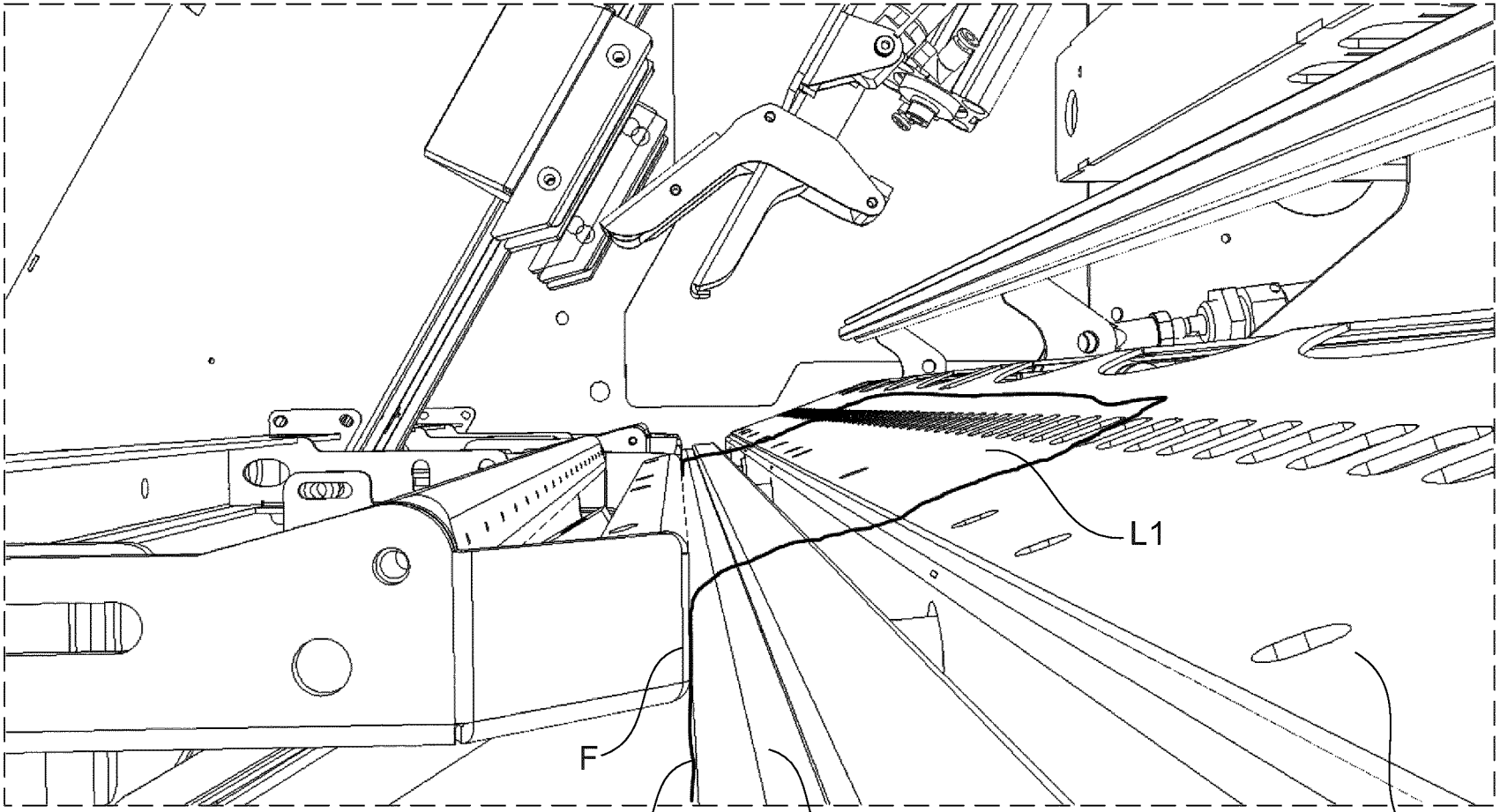
Figure 12:
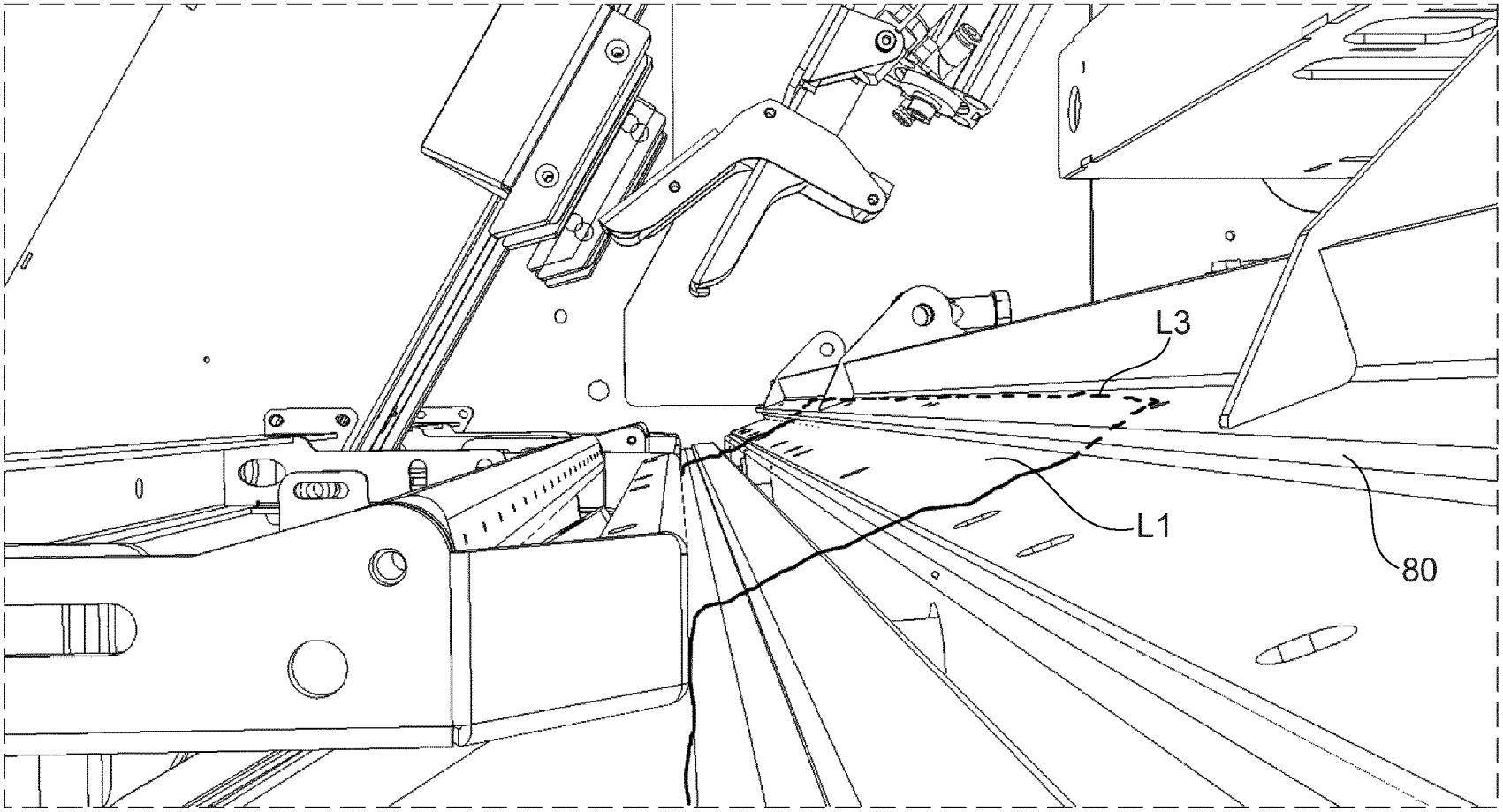
Figure 14:
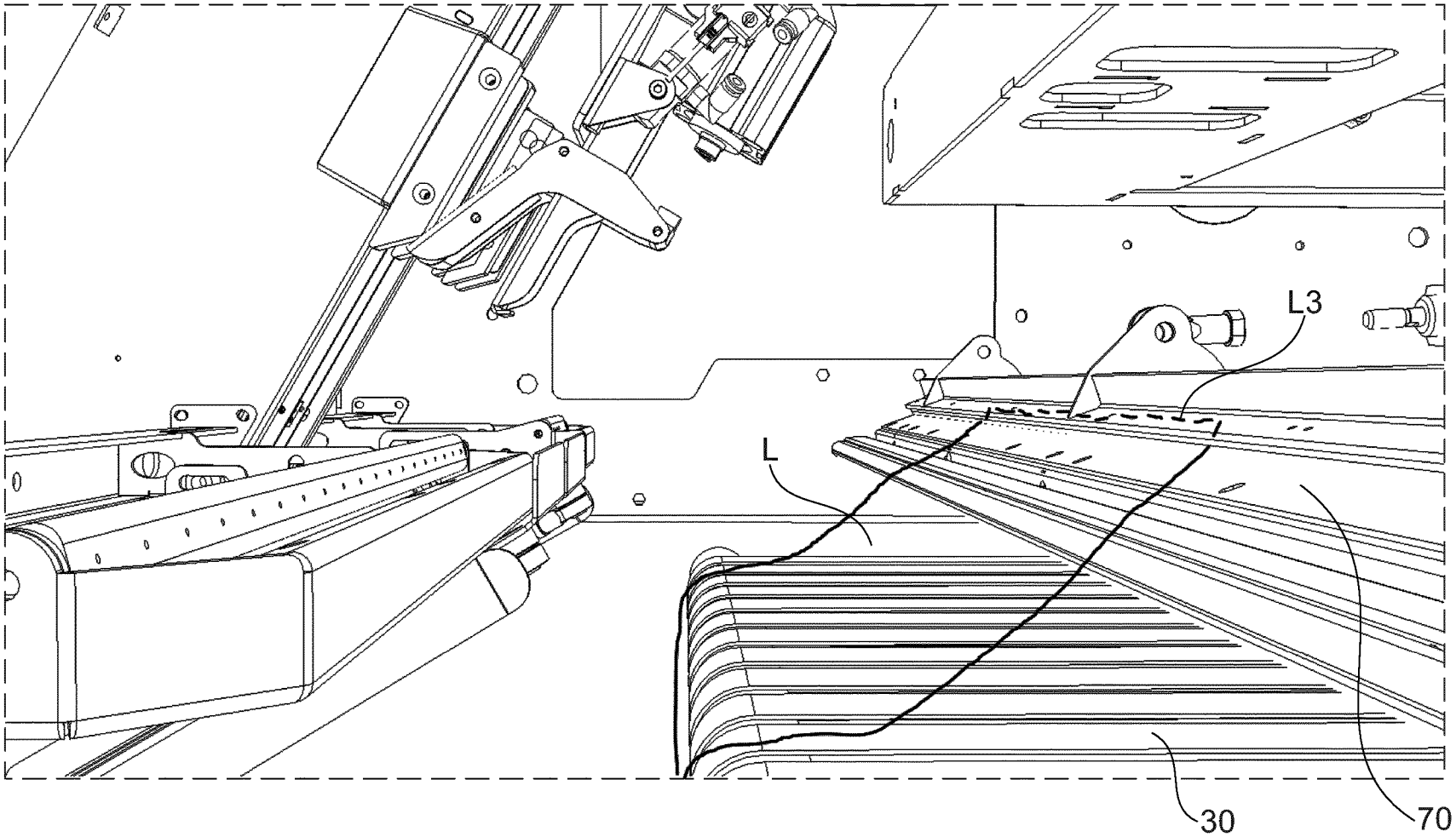
FIGS. 14-16 are views similar to FIG. 3, showing steps in the transfer of the piece of linen of FIGS. 6-13 from the transfer beam to the conveyor.
Figure 15:
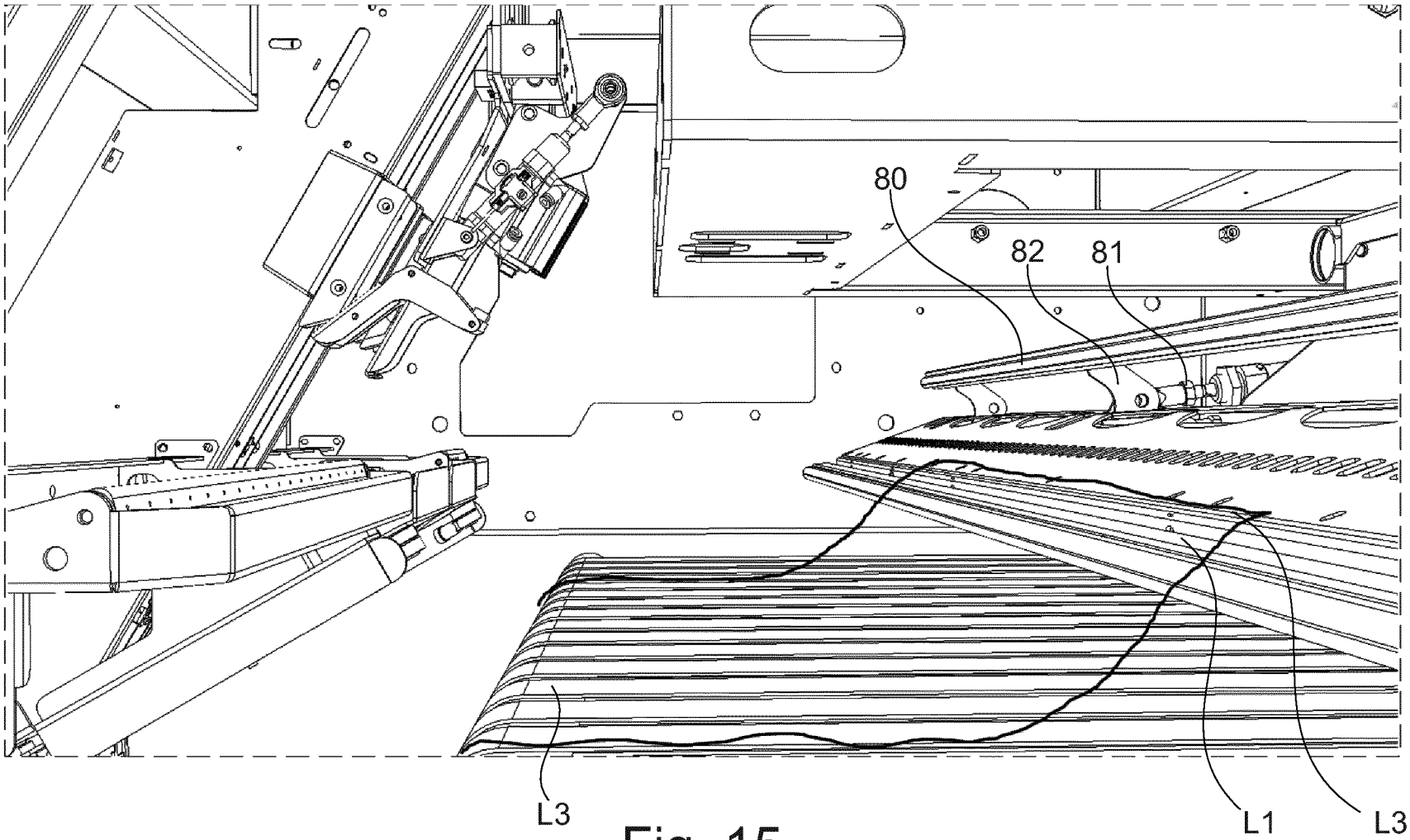
Figure 16:
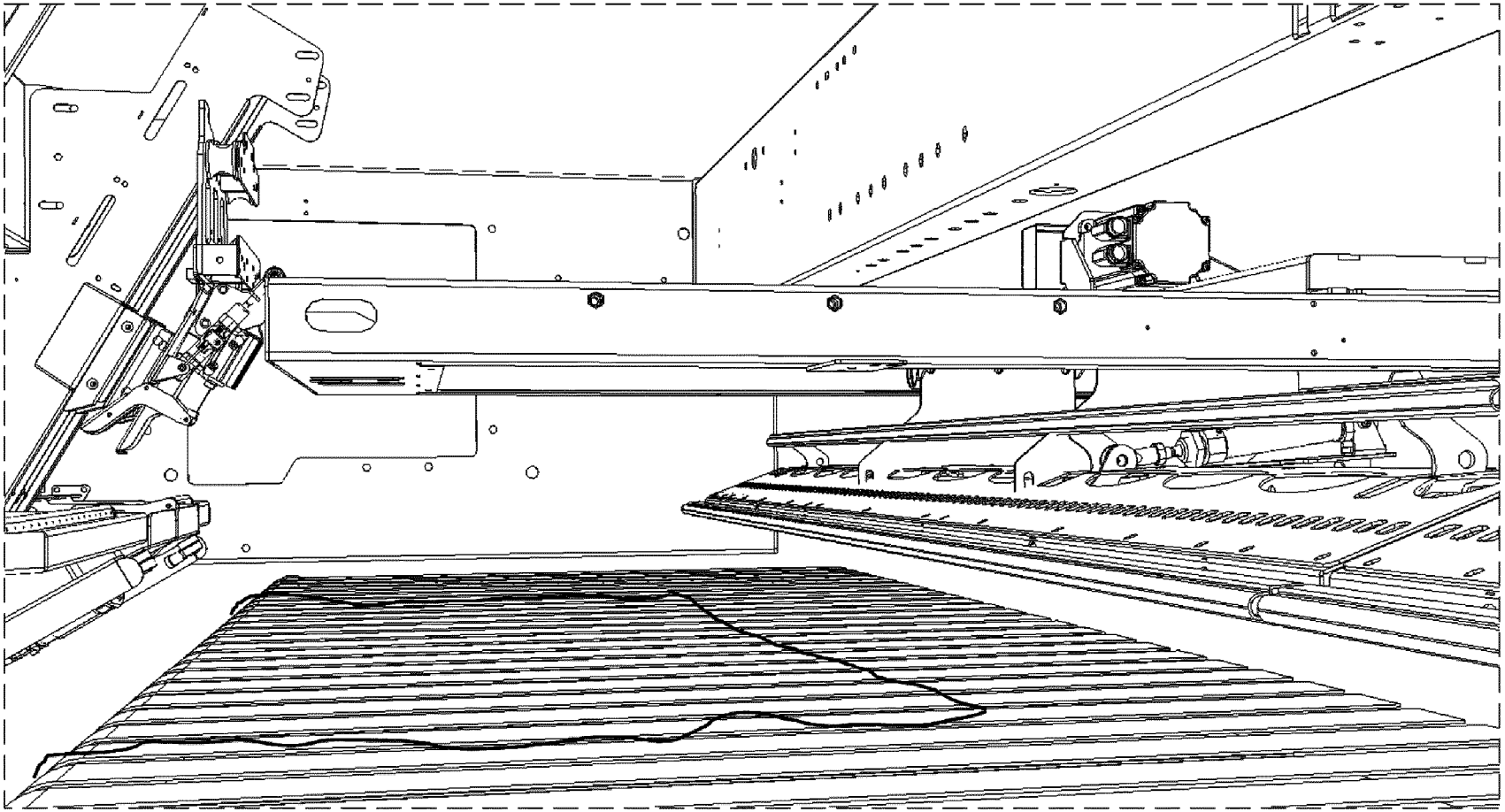

FIGS. 14-16 show the following steps carried out to arrange the piece of linen onto the conveyor 30 where the transfer beam 70, normally with the leading edge 72 positioned adjacent to the main body 76 immediately after it has left the abutment face F, is moved towards its fully retracted position shown in FIG. 16. In FIG. 14 the transfer beam 70 still holding on to the piece of linen L moves to the right, normally with essentially the same speed as the conveyor 30, and when a sufficient length of the piece of linen L has been drawn up onto the conveyor 30 the clamping structure 80 is moved to release the leading portion L1 of the piece of linen L, as shown in FIG. 15, following which the movement of the transfer beam 70 is controlled such that the leading portion L1 of the piece of linen L slides fully off the transfer beam 70 and onto the conveyor 30, as shown in FIG. 16, whereafter the transfer beam 70 moves back towards an advanced position assuming a configuration as shown in FIG. 7 or 10, depending on signals received from the aforementioned sensors.

In the fully retracted position of the transfer beam 70 shown in FIG. 16 the leading edge 72 is normally always moved to the position adjacent to the main body 76, corresponding to a minimum transfer beam 70 width W. The trailing edge 74 will in that position normally always be at the same distance from the front end 31 of the conveyor 30.

The invention claimed is:

1. A linen spreader apparatus comprising:

a conveyor defining a machine direction, a pair of spreader clamps movable transversally to said machine direction towards each other, and away from each other for spreading out a piece of linen, at least one charger station, said at least one charger station configured to deliver a corner of a leading portion of a piece of linen to one of said spreader clamps, an elongated transfer beam extending transversally to said machine direction configured to transfer a piece of spread out linen from said pair of spreader clamps to said conveyor, said transfer beam having a leading edge and being arranged to move back and forth parallel with said machine direction between advanced and retracted positions, said leading edge of said transfer beam located in a region below said spreader clamps in said advanced position, said transfer beam being configured for temporarily holding a portion of said piece of linen onto an upper surface as the transfer beam moves from said advanced position towards said retracted position, an abutment structure extending transversally to said machine direction and having an abutment face configured to hold a portion of said piece of linen between said leading edge of said transfer beam and said abutment face, a plurality of pressurised air exits configured to direct said leading portion of said piece of linen onto said transfer beam when said piece of linen is released from said spreader clamps, said transfer beam having a main body with said upper surface, wherein said leading edge is movable to and from said main body.

2. The linen spreader apparatus of claim 1, wherein said transfer beam further comprises one or more actuators for moving said leading edge to and/or from said main body.

3. The linen spreader apparatus of claim 1, further comprising one or more gates movable between a first position and a second position, said gates defining a part of said abutment face in said first position.

4. The linen spreader apparatus of claim 3, each charger station including a pair of feeder clamps, each feeder clamp of said pair of feeder clamps configured to deliver one corner of a leading portion of said piece of linen to one of said spreader clamps, said second position configured to permit moving of said piece of linen by said feeder clamps along a pathway into a housing of said linen spreader apparatus, and said first position blocking said pathway.

5. The linen spreader apparatus of claim 3, wherein said movable gates include one or more of said air exits.

6. The apparatus according to claim 1, said transfer beam configured for said temporary holding by vacuum or by a clamping structure.

7. The apparatus according claim 6, wherein said clamping structure is an elongated clamping structure arranged at a trailing edge of said transfer beam.

8. The linen spreader apparatus according to claim 1, said leading edge being biased towards a position distant from said main body, wherein a movement of said main body opposite said machine direction moves said leading edge to a position adjacent said main body against said bias, said linen spreader apparatus further comprising a lock for temporary locking of said leading edge in said position adjacent said main body while said transfer beam is moved towards said retracted position.

9. The linen spreader apparatus according to claim 1, including a plurality of said pairs of spreader clamps.

10. A method of operating the linen spreader apparatus according to claim 1, comprising the steps of:

positioning corners of a leading portion of a piece of linen in feeder clamps of a charger station, delivering a respective one of said corners to a respective one of said spreader clamps, moving said leading edge to or from said main body, moving said transfer beam to an advanced position for said leading edge to hold a portion of said piece of linen between said leading edge and said abutment face, releasing said piece of linen from said spreader clamps, and temporarily holding a portion of said piece of linen onto said upper surface of said main body of said transfer beam while moving said transfer beam from said advanced position towards said retracted position.

11. The method of claim 10, further comprising the step of moving said leading edge to a position adjacent said main body before said transfer beam reaches said retracted position.

12. The method of claim 10, further comprising providing one or more gates movable between a first position and a second position and wherein each charger station includes a pair of feeder clamps, and the initial step of moving, with said or more gates in said second position, said piece of linen by said feeder clamps along a pathway into a housing of said linen spreader apparatus, and then moving said one or more gates into said first position.

13. The method of claim 12, further comprising the step of discharging air from air exits of said gates.

* * * * *